US006144148A

United States Patent [19]

Tong et al.

[11] Patent Number: 6,144,148

[45] Date of Patent: Nov. 7, 2000

[54] THERMAL EXPANSION FOR COLOR CRT

[75] Inventors: Hua-Sou Tong, Cary, N.C.; Wen-Chi Chen, Taipei; Hao-Cheng Hung, Hsinchu County, both of Taiwan

[73] Assignee: Chunghwa Picture Tubes, Ltd., Yangmei/Taoyuan, Taiwan

[21] Appl. No.: 09/132,134

[22] Filed: Aug. 10, 1998

[51] Int. Cl.[7] ..... H01J 29/80

[52] U.S. Cl. ..... 313/407; 313/402; 313/406

[58] Field of Search ..... 313/402, 404, 313/405, 406, 407

[56] References Cited

U.S. PATENT DOCUMENTS

| | | | |
|---|---|---|---|
| 3,735,190 | 5/1973 | Say | 315/13 |
| 4,065,693 | 12/1977 | Gijrath | 313/406 |
| 4,164,682 | 8/1979 | Palac | 313/404 |
| 4,491,763 | 1/1985 | Fujinuma et al. | 313/405 |
| 4,810,927 | 3/1989 | Watanabe | 313/402 |
| 4,971,590 | 11/1990 | Tong | 445/47 |
| 5,072,150 | 12/1991 | Lee | 313/405 |
| 5,126,624 | 6/1992 | Ji | 313/407 |
| 5,210,459 | 5/1993 | Lee | 313/406 |
| 5,451,833 | 9/1995 | Tong | 313/402 |
| 5,534,746 | 7/1996 | Marks et al. | 313/408 |
| 5,680,004 | 10/1997 | Ragland, Jr. | 313/405 |
| 5,717,280 | 2/1998 | Lee | 313/404 |
| 5,989,259 | 4/1999 | Reyel | 313/407 |

*Primary Examiner*—Nimeshkumar D. Patel
*Assistant Examiner*—Michael J. Smith
*Attorney, Agent, or Firm*—Emrich & Dithmar

[57] ABSTRACT

A holder for maintaining an apertured shadow mask in fixed relation to the display screen of a color cathode ray tube (CRT) includes the combination of a mounting stud attached to an inner portion of the CRT's glass envelope and an apertured resilient metal holder attached to the shadow mask's peripheral frame and adapted to receive the mounting stud in a tight-fitting manner. A plurality of such mounting stud/metal holder combinations securely attach the top, bottom and lateral edges of the shadow mask frame to adjacent inner portions of the CRT's glass envelope adjacent its display screen. Heating of the shadow mask caused by the CRT's electron beams incident thereon gives rise to heating and thermal expansion of the shadow mask metal holders. Thermal expansion of the metal holders causes the shadow mask to rotate about the CRT's central axis resulting in a shift of the shadow mask apertures with respect to video image-producing phosphor deposits on the display screen's inner surface which degrades video image color purity. To prevent misalignment of the shadow mask apertures with the phosphor deposits caused by shadow mask holder thermal expansion, the shadow mask holders are formed from a material having a low coefficient of thermal expansion which maintains the shadow mask and its apertures in a fixed, predetermined location and orientation during CRT operation. The shadow mask holders are preferably comprised of a material having a coefficient of thermal expansion of less than $2.0\times10^{-6}$ cm/cm/° C. such as, for example, Invar, Neovar or Kovar.

4 Claims, 1 Drawing Sheet

THERMAL EXPANSION FOR COLOR CRT

FIELD OF THE INVENTION

This invention relates generally to color cathode ray tubes (CRTs) having an apertured shadow mask for controlling electron beam incidence upon phosphor elements on the CRT's display screen and is particularly directed to a mounting arrangement for the shadow mask which maintains the mask's apertures in alignment with the display screen phosphor elements when the shadow mask is heated by the electron beams incident thereon during CRT operation.

BACKGROUND OF THE INVENTION

A color CRT employs an apertured shadow mask disposed a predetermined distance from the CRT's display screen which serves as a color selection electrode by shadowing, or blocking, all but selected ones of the individual light-emitting phosphors on the display screen from its corresponding electron beam-emitting source located in the neck of the CRT. By blocking two of the electron beams while permitting the third to be incident upon its designated light-emitting phosphor elements, a video image comprised of the three primary colors red, green and blue is presented on the CRT's display screen. The shadow mask has a very large number of electron beam passing apertures and is in the form of a thin sheet of a high strength metal. The shadow mask is maintained in a stretched condition under tension and is typically provided with a slight curvature. For example, in a typical 14-inch color CRT, the shadow mask is provided with a curvature of 1R.

The shadow mask is disposed within and attached to a peripheral frame. Disposed about the shadow mask frame and attached to respective upper, lower and lateral portions of the shadow mask frame are typically four resilient metal holders, or springs. During CRT operation, the shadow mask is heated by the electron beams incident thereon. To compensate for the thermal related shadow mask aperture shift relative to the display screen's phosphor elements, prior art approaches have employed bimetallic shadow mask holders which incorporate a first metal having a high coefficient of thermal expansion in side-by-side combination with a second metal having a low coefficient of thermal expansion with various surface area ratios. This type of shadow mask installation compensates for shadow mask aperture shift caused by mask doming by moving the mask/frame assembly along the longitudinal axis (Z-axis) of the CRT toward the CRT's display screen. Some of this heat is transferred to the metal holders maintaining the shadow mask in position within the CRT glass envelope. Heating of the resilient metal holders causes the metal holders to also undergo thermal expansion causing the four resilient metal holders to rotationally displace the shadow mask in the X-Y plane of the shadow mask about the longitudinal axis of the CRT. Rotation of the shadow mask is due to the axis of deformation of the four metal holders which is along their respective longitudinal axes. Shadow mask rotation also results in misregistration of the shadow mask apertures with the display screen's phosphor elements causing a degradation of video image color purity. The resilient metal holders are typically of the bi-metal type and are used in combination with a shadow mask typically comprised of aluminum killed (AK) steel. Problems of electron beam landing misregistration and color purity degradation become even more severe in the case of shadow masks with finer aperture pitch and flatter configurations as commonly encountered in larger CRTs. In larger CRTs employing flatter shadow masks, e.g., 15" CRTs and larger, where the aluminum killed (AK) steel shadow mask can no longer provide the required electron beam landing registration requirements, an Invar shadow mask is generally used, with the bi-metallic shadow mask holders typically replaced with a single-metal holders comprised of SS-302 or SS-320 stainless steel because there is now no need to compensate along the Z-axis. However, the shadow mask rotation problem still remains with these stainless steel shadow mask holders because of their relatively high coefficient of thermal expansion. The problem of electron beam misregistration becomes even more severe in the case of shadow masks with finer aperture pitch and flatter configurations as commonly encountered in larger CRTs.

The present invention addresses the aforementioned limitations of the prior art by providing a shadow mask mounting arrangement employing materials having a very low coefficient of thermal expansion, i.e., preferably below $2.0\times10^{-6}$ cm/cm/° C. Representative shadow mask holder materials include Invar, Neovar and Kovar. Because of the very low coefficient of thermal expansion of these materials, directional rotation of the shadow mask during CRT operation is substantially reduced for improved video image color purity.

OBJECTS AND SUMMARY OF THE INVENTION

Accordingly, it is an object of the present invention to provide a mounting arrangement for an apertured shadow mask in a color CRT which maintains the mask's beam passing apertures in alignment with phosphor elements on the CRT's display screen during CRT operation.

Another object of the present invention is to provide a support structure for a shadow mask in a color CRT which does not undergo thermal deformation when the shadow mask is heated during CRT operation.

Yet another object of the present invention is to provide an apertured shadow mask holder for use in a color CRT having a very low coefficient of thermal expansion which does not change the orientation and location of the mask's apertures relative to the CRT's display screen to provide a high degree of video image color purity.

This invention contemplates a mounting arrangement for attaching an apertured shadow mask to an inner portion of a glass envelope of a color cathode ray tube (CRT) and for maintaining the shadow mask in fixed, spaced relation from a display screen of the CRT, wherein the shadow mask is heated by a plurality of electron beams incident thereon, the arrangement comprising a metal frame attached to and disposed about the periphery of the shadow mask; a plurality of studs attached in a spaced manner to an inner portion of the CRT's glass envelope; and a plurality of holders each coupled to a respective stud and attached to the metal frame for maintaining the metal frame in fixed relation to the display screen, wherein each of the holders is comprised of a metal alloy having a coefficient of thermal expansion of less; than $2.0\times10^{-6}$ cm/cm/° C.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
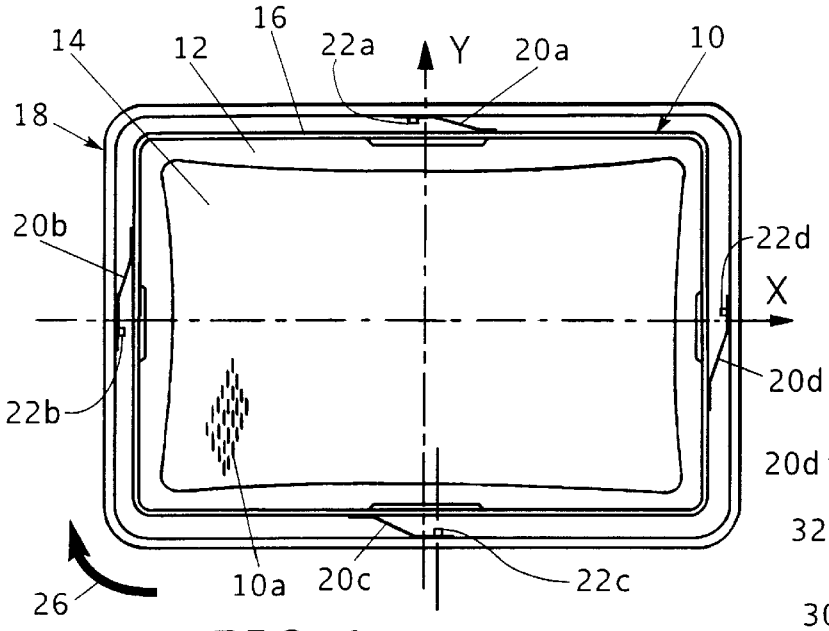
FIG. 1 is a plan view of a shadow mask and mask mounting arrangement in the glass envelope of a color CRT in which the present invention is intended for use.
Figure 3:
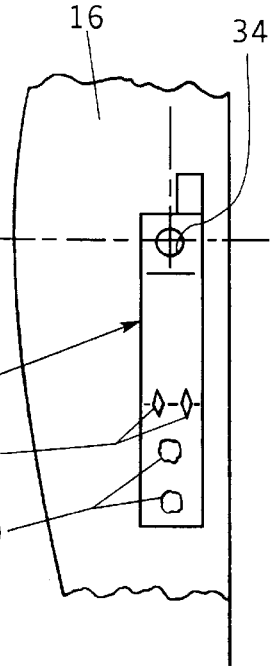
FIGS. 2 and 3 are plan views showing details of a pair of resilient metal holders used to attach the shadow mask to the CRT's glass envelope in the shadow mask mounting arrangement of FIG. 1.
Figure 2:
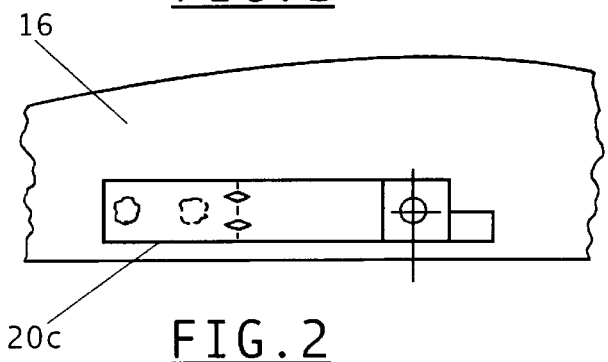
Figure 4:
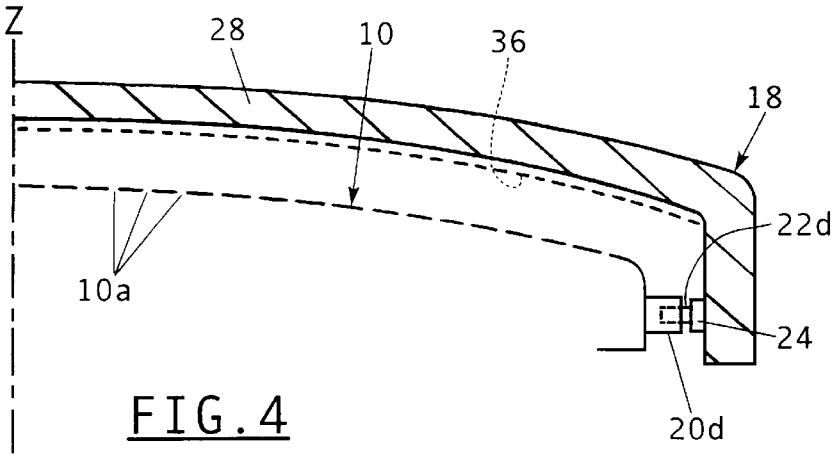
FIG. 4 is a partial sectional view showing additional details of the mounting arrangement for attaching a shadow mask to the glass envelope of a color CRT in accordance with the present invention.

Referring to FIG. 1, there is shown a plan view of an installation for mounting a shadow mask 10 within the glass envelope 18 of a color CRT in accordance with the present invention. Additional details of the resilient metal holders used for attaching the shadow mask 10 to the inner surface of the CRT's glass envelope 18 are shown in FIGS. 2 and 3. FIG. 4 is a partial sectional view of shadow mask 10 shown in closely spaced relation to a display screen, or glass faceplate, 28 attached to the front of the CRT's glass envelope 18. The configuration of the components in the shadow mask mounting arrangement shown in FIGS. 1–4 is as in conventional prior art shadow mask mounting arrangements, however, the use of new materials in the mask support and positioning mechanisms, as described in detail below, provides functions and advantages not heretofore available in color CRTs.

Shadow mask 10 includes an inner portion 14 having a plurality of spaced electron beam passing apertures, some of which are shown as elements 10*a* in FIG. 1. Disposed about and connected to the inner apertured portion 14 of shadow mask 10 is a shadow mask skirt 12. The shadow mask's inner apertured portion 14 and outer skirt 12 form a generally planar, or flat, structure. Attached to the outer periphery of the shadow mask skirt 12 by conventional means such as weldments and disposed about the shadow mask skirt is a shadow mask frame 16 having a generally rectangular shape. Disposed about the shadow mask frame 16 and attached to respective upper, lower and lateral portions of the shadow mask frame are four resilient metal holders, or springs, 20*a*, 20*b*, 20*c* and 20*d*. All four resilient metal holders are identical in configuration, structure and function, with plan views of resilient metal holders 20*c* and 20*d* respectively shown in FIGS. 2 and 3. Resilient metal holder 20*d* is described in detail below, with the description provided being equally applicable to the remaining three holders.

A first end of resilient metal holder 20*d* is securely attached to the shadow mask frame 16 by conventional means such as spot weldments 30. Incorporated in resilient metal holder 20*d* are a pair of spaced embossed portions 32 which facilitate flexure of an intermediate portion of the metal holder relative to the first end portion attached to the shadow mask frame 16. A second, opposed end of the resilient metal holder 20*d* is provided with an aperture 34 for receiving a mounting stud attached to an inner surface of the CRT's glass envelope 18. Thus, each of the four resilient metal holders 20*a*–20*d* includes a respective aperture for receiving in a tight-fitting manner a respective mounting stud 22*a*–22*d* as shown in FIG. 1. Each of the mounting studs 22*a*–22*d* is attached to an inner surface of the CRT's glass envelope 18 by means of a respective mounting fixture, as shown for the combination of mounting stud 22*d* and mounting fixture 24 in the partial sectional view of FIG. 4. Each combination of a mounting pin and mounting fixture is attached to the inner surface of the CRT's glass envelope 18 by conventional means such as a heat seal, weldment or glass frit, which is not shown in the figures for simplicity.

As also shown in FIG. 4, shadow mask 10 with its large number of electron beam passing apertures 10*a* is disposed in closely spaced relation to the CRT's display screen 28 on a forward portion of the CRT's glass envelope 18. Disposed on an inner surface of the CRT's display screen 28 is a phosphor layer 36 comprised of a large number of discrete phosphor deposits, or elements, which emit light when an electron beam is incident thereon to produce a video image on the display screen.

Shadow mask 10 undergoes thermal deformation as a result of the electron beams which are directed onto the shadow mask and in large part pass through its many apertures 10*a*. Those portions of the incident electron beams which do not transit the apertures 10*a* in shadow mask 10 raise the temperature of the shadow mask producing the aforementioned thermal deformation, which is commonly referred to as mask "doming." Because of this heating of the shadow mask 10 and the metal-to-metal contact between the shadow mask and each of the four resilient metal holders, heat is transferred from the shadow mask to each of the four resilient metal holders. In prior art shadow mask mounting installations, heating of the resilient metal holders results in the metal holders also undergoing thermal deformation causing the four resilient metal holders to rotationally displace the shadow mask in a clockwise direction in an X-Y plane, or in the direction of arrow 26 in FIG. 1. Clockwise rotation of the shadow mask is due to the axis of deformation of the four metal holders which is along their respective longitudinal axes and gives rise to misalignment of the beam passing apertures in the shadow mask with phosphor deposits on the inner surface of the CRT's display screen which degrades video image color purity. The present invention substantially eliminates rotational displacement of the shadow mask caused by shadow mask holder thermal deformation and the resulting misalignment of its apertures with the aforementioned phosphor deposits during CRT as described in the following paragraphs.

In accordance with the present invention, each of the resilient metal holders 20*a*–20*d* is comprised of a metal alloy having a coefficient of thermal expansion of less than $2.0\times10^{-6}$ cm/cm/° C. The low coefficient of thermal expansion of the inventive shadow mask holders allows the shadow mask holders to not change in shape or size when heated by the high temperature shadow mask during CRT operation. The non-thermal deforming mask holders do not cause rotation of the shadow mask-frame assembly in the x-y plane of the mask. Elimination of shadow mask shift during CRT operation maintains the shadow mask apertures in precise alignment with the corresponding phosphor deposits on the inner surface of the CRT's display screen for improved video image color purity. It has been found that a shadow mask holder composition comprised of at least 32–38% atomic weight of nickel provides a material having a coefficient of thermal expansion of less than $2.0\times10^{-6}$ cm/cm/° C. The material selected for the shadow mask holders must be suitable in yield strength, ultimate tensile strength, mechanical characteristics, machineability and weldability for this application. Materials found suitable for this application include Invar, Neovar and Kovar. Because of the very low coefficient of thermal expansion of the aforementioned materials, directional rotation of the shadow mask is minimized during CRT operation. Shadow mask holders comprised of the aforementioned materials should preferably also be blackened to further improve their thermal emissivity to further reduce the possibility of shadow mask rotation and misalignment of shadow mask apertures with the phosphor deposits on the inner surface of the CRT's display screen. Shadow mask holder blackening is accomplished by heating the holder to a high temperature in a natural gas environment to form a combination of $Fe_2O_3$ and $Fe_3O_4$ on the surface of the holder. The coefficient of thermal expansion of Invar is $0.8\times10^{-6}$ cm/cm/° C. The use of the aforementioned materials in a color CRT shadow mask substantially improves the color purity of the video image presented by the CRT, particularly in the corners of the display screen of high resolution CRTs.

There has thus been shown an improved shadow mask holder for maintaining an apertured shadow mask in fixed relation to the display screen of a color CRT. A plurality of such holders engage respective peripheral edges of the shadow mask's support frame in attaching the shadow mask to an inner portion of the CRT's glass envelope adjacent its display screen. Each of the mask holders is comprised of a material having a coefficient of thermal expansion of less than $2.0\times10^{-6}$ cm/cm/° C. Materials comprised of at least 32–38% atomic weight of nickel, such as Invar, Neovar and Kovar, have been found to afford the minimum holder thermal expansion for minimizing shadow mask rotation when the shadow mask is heated by energetic electrons incident thereon during CRT operation. To further reduce the possibility of shadow mask rotation during CRT operation, the surface of each of the shadow mask holders may be blackened to further increase its thermal emissivity. Minimizing shadow mask rotation substantially improves the color purity of a video image presented on the CRT's display screen, particularly in the corners of the display screen of a high resolution CRT.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A mounting arrangement for attaching an apertured shadow mask to an inner portion of a glass envelope of a color cathode ray tube (CRT) and for maintaining the shadow mask in fixed, spaced relation from a display screen of said CRT, wherein the shadow mask is heated by a plurality of electron beams incident thereon, said arrangement comprising:

a metal frame attached to and disposed about the periphery of the shadow mask;

a plurality of studs attached in a spaced manner to an inner portion of the CRT's glass envelope; and a plurality of holders each coupled to a respective stud and attached to said metal frame for maintaining said metal frame in fixed relation to the display screen, wherein each of said holders is a unitary body of generally uniform composition and is comprised of a metal alloy having a coefficient of thermal expansion of less than $2.0\times10^{-6}$ cm/cm/° C., wherein each of said holders includes a blackened outer surface of $Fe_2O_3$ and $Fe_3O_4$ for improved thermal emissivity.

2. The mounting arrangement of claim 1 wherein each of said holders is comprised of at least 32–38% atomic weight of nickel.

3. The mounting arrangement of claim 2 wherein each of said holders is comprised of Invar, Neovar or Kovar, or a combination thereof.

4. In a mounting arrangement for an apertured shadow mask in a color cathode ray tube (CRT) wherein the shadow mask is heated by a plurality of electron beams incident thereon and wherein a plurality of attachment mechanisms engage and support the shadow mask and maintain the shadow mask in fixed relation to the CRT's display screen, the improvement comprising:

the attachment mechanisms in the form of a unitary body of generally uniform composition having a blackened outer surface of $Fe_2O_3$ and $Fe_3O_4$ and comprised of a metal having a coefficient of thermal expansion in the range of $2.0\times10^{-6}$ cm/cm/° C.

* * * * *